US011465269B2

(12) United States Patent
Brull

(10) Patent No.: US 11,465,269 B2
(45) Date of Patent: Oct. 11, 2022

(54) LANYARD SYSTEM FOR POWER TOOLS

(71) Applicant: James Gregory Brull, Leander, TX (US)

(72) Inventor: James Gregory Brull, Leander, TX (US)

( * ) Notice: Subject to any disclaimer, the term of this patent is extended or adjusted under 35 U.S.C. 154(b) by 61 days.

(21) Appl. No.: 17/261,154

(22) PCT Filed: Jul. 20, 2018

(86) PCT No.: PCT/US2018/043194
§ 371 (c)(1),
(2) Date: Jan. 18, 2021

(87) PCT Pub. No.: WO2020/018122
PCT Pub. Date: Jan. 23, 2020

(65) Prior Publication Data
US 2021/0268639 A1 Sep. 2, 2021

(51) Int. Cl.
*B25F 5/02* (2006.01)
*B25F 1/02* (2006.01)

(52) U.S. Cl.
CPC ..... *B25F 5/029* (2013.01); *B25F 1/02* (2013.01)

(58) Field of Classification Search
CPC ..... B25H 3/003; B25G 1/08; B25B 15/00; B25B 21/007
USPC ..... 81/439
See application file for complete search history.

(56) References Cited

U.S. PATENT DOCUMENTS 6,029,549 A * 2/2000 Baker ..... B25B 23/0021 81/439
6,742,421 B1 * 6/2004 Chen ..... B25G 1/085 81/439
2005/0221963 A1 * 10/2005 Prismall ..... B65H 75/368 482/121
2006/0162508 A1 * 7/2006 Liu ..... B25G 1/085 81/439
2007/0251358 A1 * 11/2007 Grand ..... B25G 1/085 81/439
2017/0282352 A1 * 10/2017 Brull ..... B23Q 3/15706

* cited by examiner

*Primary Examiner* — David B. Thomas
*Assistant Examiner* — Jonathan G Santiago Martinez
(74) *Attorney, Agent, or Firm* — Michael A. Ervin; M. A. Ervin & Associates

(57) ABSTRACT

Multiple attached lanyard systems for attaching to a power tool, with each lanyard system comprising a lanyard attached to a driver piece holder that holds a driver piece and is connected to a retraction system. The multiple attached lanyard systems providing a different driver pieces that can be selected by pulling each driver piece out of its attached lanyard system, extending the driver piece past a driver piece receiver and inserting the driver piece into the driver piece receiver.

10 Claims, 12 Drawing Sheets

LANYARD SYSTEM FOR POWER TOOLS

CROSS-REFERENCE TO RELATED APPLICATIONS

Not applicable.

FIELD

This disclosure relates generally to power tools. More particularly, it relates to supporting and retaining a removable piece that is used with a power tool, such as an impact driver, drill, hammer drill, nut spinner, impact wrench, reciprocating saw, paint sprayer, sand blaster or water blaster. Described herein is a retracting lanyard for a drill bit, screw bit, socket driver, chisel, saw blade, or nozzle. In short, this lanyard system stores, tethers, retains, extends and retracts a driver piece that is fixed in and removed from a tool. The driver piece is designed to perform a task such as, but not limited to tightening, loosening, drilling, chiseling, cutting, spraying or a combination thereof.

BACKGROUND

Power tools with removable pieces are capable of performing a wider variety of tasks than those tools with fixed pieces. For example, a nut driver with removable sockets or a screw driver with removable screw bits are capable of tightening or loosening a wider variety of nuts, bolts or screws than a wrench or screw driver with a fixed working end. In fact, a driver adapted to handle both sockets and screw bits can perform the task of tightening and loosening both nuts, bolts and screws without the need for a tool box of wrenches and screw drivers. The same can be said for power tools and sprayers configured with a piece receiver, such as a chuck or quick change coupler. However, the challenge arises in keeping track of the multiple pieces to be placed in the piece receiver (chuck or quick change coupler). Another challenge is quick and easy accessibility to multiple pieces.

Described herein is a low cost lanyard system to store, and manage through the use of a retractable tether one or a plurality of pieces to be used with a tool. The lanyard systems described herein can be incorporated into a tool with modest changes to the top of the power tool housing. The described lanyard system is a low profile system allowing easy location and selection of the desired tethered piece from a storage position and move a tethered piece into a piece receiver (like a chuck or quick change coupler) with little or no need to tend the lead of the tether into and about the work area of the tool. It further provides a lanyard system in which a piece or plurality of pieces remains safely tethered to the tool even when mounted in a piece receiver (like a chuck or quick change coupler). And provides a lanyard system with a retraction system capable of retrieving and storing a tethered piece once released from a piece receiver or the work region with little or no intervention by a user.

BRIEF SUMMARY

A lanyard system for a driver piece connected to a power tool housing including at least: a lanyard assembly having a first end and a second end contained with a lanyard assembly housing; the lanyard assembly further including at least a lanyard strap with two end regions, the first end region attached to a driver holder holding a driver piece outside of the lanyard assembly housing and the second end region attached to an internal stop within the lanyard assembly housing; the lanyard strap of the lanyard assembly deployed into a first guiding tray within lanyard assembly housing enclosing the lanyard assembly; the internal stop within the lanyard assembly housing attached to a first end of a retraction system which encircles 180 degrees around a pully at the second end of the lanyard assembly and returns within a second guiding tray of the lanyard assembly housing enclosing the lanyard assembly; the second end of the retraction system attached to the first end of the lanyard assembly contained within the lanyard assembly housing.

DETAILED DESCRIPTION

In the following detailed description, reference is made to accompanying drawings that illustrate embodiments of the present invention. These embodiments are described in sufficient detail to enable a person of ordinary skill in the art to practice the invention without undue experimentation. It should be understood, however, that the embodiments and examples described herein are given by way of illustration only, and not by way of limitation. Various substitutions, modifications, additions, and rearrangements may be made without departing from the spirit of the present invention. Therefore, the description that follows is not to be taken in a limited sense, and the scope of the present invention will be defined only by the final claims.

Figure 1:
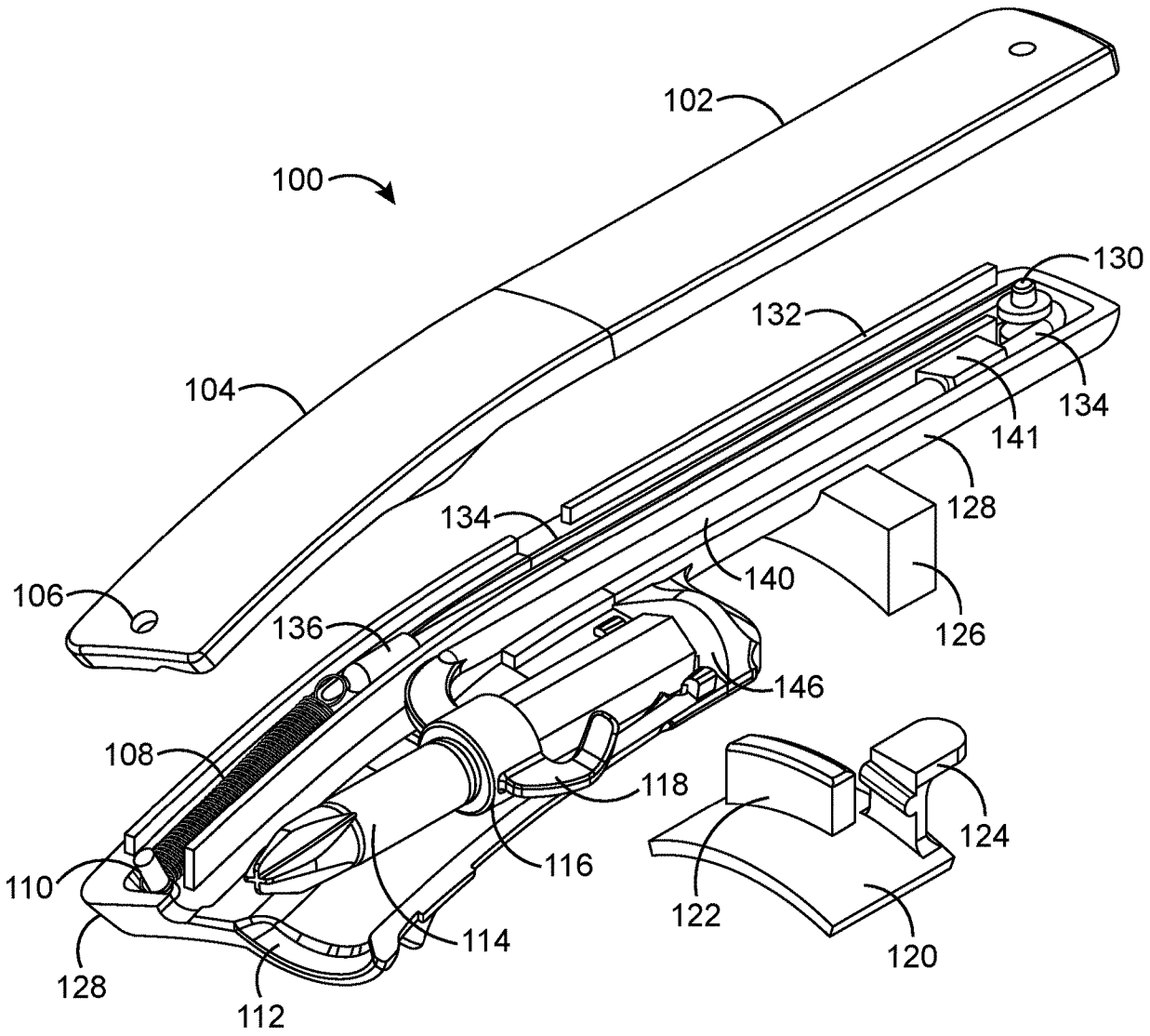
FIG. 1 is an exploded perspective view of an individual lanyard system, utilizing a flexible cord and spring design, that can be mounted on a power tool.
Figure 2:
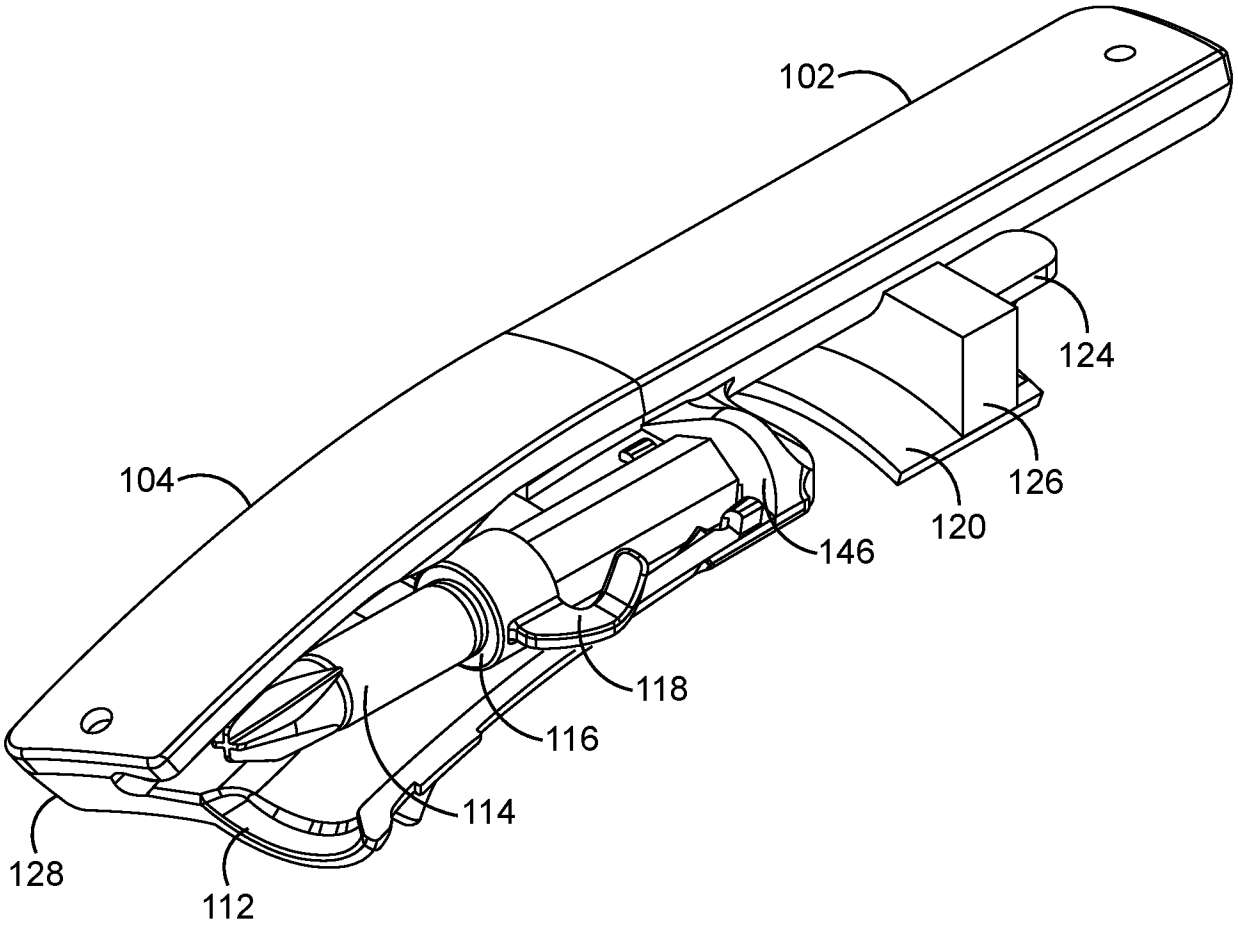
FIG. 2 is a perspective view of the individual lanyard system of FIG. 1, with top covers.

Referring to FIG. 1, an independent lanyard system 100 is shown in an exploded perspective view. It is termed independent in that multiple of these lanyard systems can be attached to a power tool, but do not rely on each other. Each independent lanyard system is self-sufficient. The lanyard system is made up of a lanyard assembly having a first end and a second end contained within a covered lanyard assembly housing 128,102,104. The assembly includes a lanyard strap 140 with two end regions with the first end region attached via a driver holder 116 to a driver piece 114 outside of the lanyard assembly housing. The lanyard strap 140 lies inside the lanyard assembly housing 128,102,104. An unexploded view with the covered housing in place is shown in FIG. 2. Returning to FIG. 1, lanyard strap 140 lies in a first guiding tray within the lanyard assembly housing. At a first end of lanyard strap 140, lying outside of the lanyard assembly housing, it is attached to a driver piece holder 116 which holds a driver piece 114, which could be a variety of driver pieces to be discussed. Attached to the driver holder 116 is a friction wing 118 which can be used to pull out the lanyard strap and driver piece 114 to attach the driver piece to the power tool housing (not yet shown). The friction wing 118 also acts to protect the driver holder 116 from the impact of the power tool in use. When not in use in the power tool (not shown) the driver piece 114 is pulled back to driver stop 146 and rests in a parking well 112 that is part of the independent lanyard system 100. At the lanyard strap's second end it is attached to an internal stop 141, which is then attached to a retraction system made up of a flexible cord 134 that is wrapped around a pully 130. The flexible cord 134 of the retraction system then runs into a second guiding tray and the end of flexible cord 134 is attached to a spring connector 136. The spring connector is then attached to a spring 108 that is fixed to a spring mount shaft 110 at the first end of the lanyard assembly. The combination from the flexible cord 134 wrapped around the pully 130 to the mounted spring 108 makes up a retraction system. The spring acts to pull the lanyard system back into the housing after being released from the power tool. A connecting system 120,122,124 designed into the power tool housing is configured to snap into receiver 126 when attaching lanyard system 100 to the power tool (not shown). An additional attachment between the lanyard system and the power tool will be shown in FIG. 5.

When housing covers 102,104 are attached to the housing 128 the completed independent lanyard system can be seen in FIG. 2.

Figure 3:
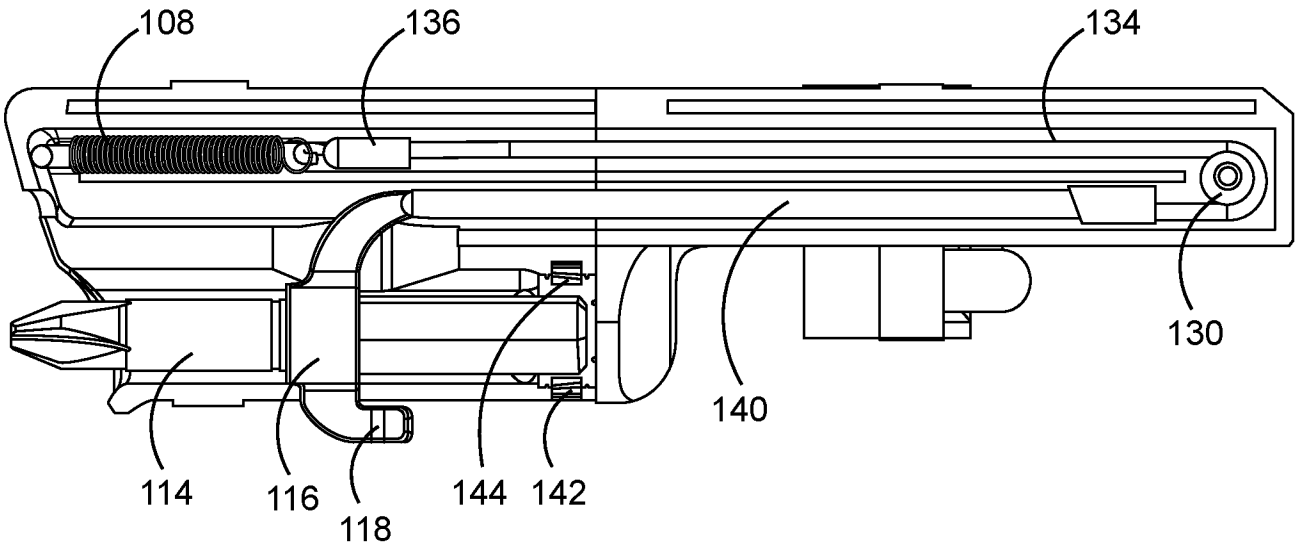
FIG. 3 is a top view of the individual lanyard system of FIG. 1, without the top covers.

FIG. 3 is a top view of the individual lanyard system of FIG. 1, without the top covers. Underlying the back end of driver piece 114 are two ends 142,144 of a magnet that maintains the driver piece in place during periods that the lanyard strap 140 is at rest and not in use in the power tool.

Figure 4:
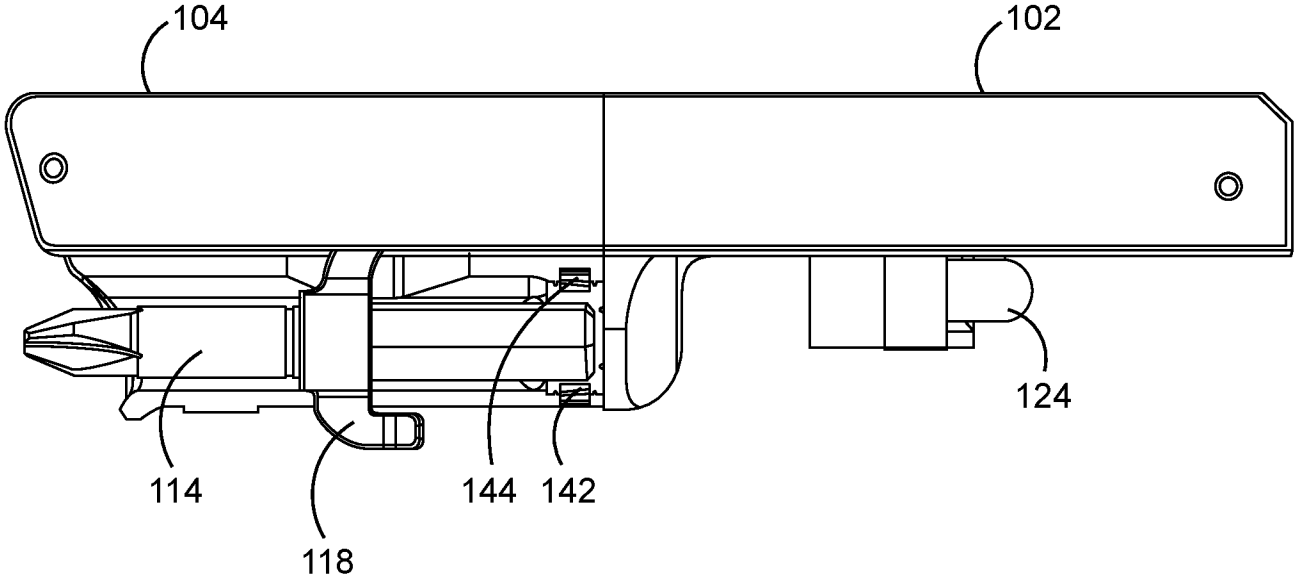
FIG. 4 is a top view of the individual lanyard system of FIG. 1, with top covers.

FIG. 4 is a top view of the individual lanyard system of FIG. 1, with top covers.

Figure 5:
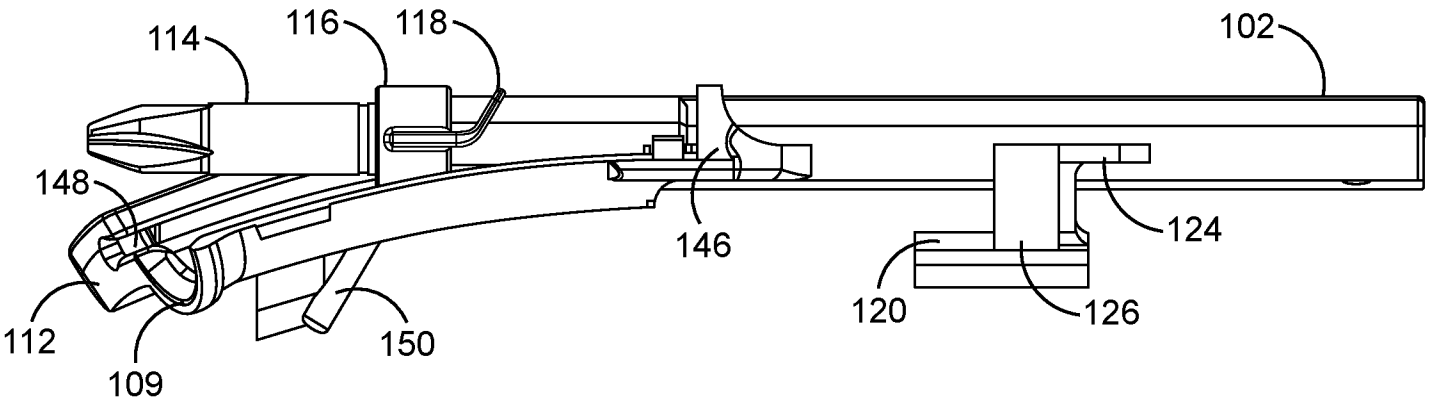
FIG. 5 is a side view of the individual lanyard system of FIG. 1, with top covers.

FIG. 5 is a side view of the individual lanyard system of FIG. 1, with top covers. In this view an additional aspect is shown, a first power tool connecting module comprising an engagement piece 150 that is used to insert into a provided hole in the power tool housing when each of the independent lanyard systems 100 is mounted onto the power tool housing. Engagement piece 150 can be a dowel or dowels that is inserted into a provided hole or holes on the top of the power tool housing or possibly a blade for sliding into a provided blade receptacle in the top of the power tool housing. A second power tool connecting module to the power tool housing is provided by connecting system 120,122,124 (see FIG. 1) designed into the power tool housing. The connecting system is configured to snap into receiver 126 (part of the individual lanyard system 100). The combination of the two power tool connecting modules enables a secure connection of the individual lanyard systems to the power tool.

Figure 6:
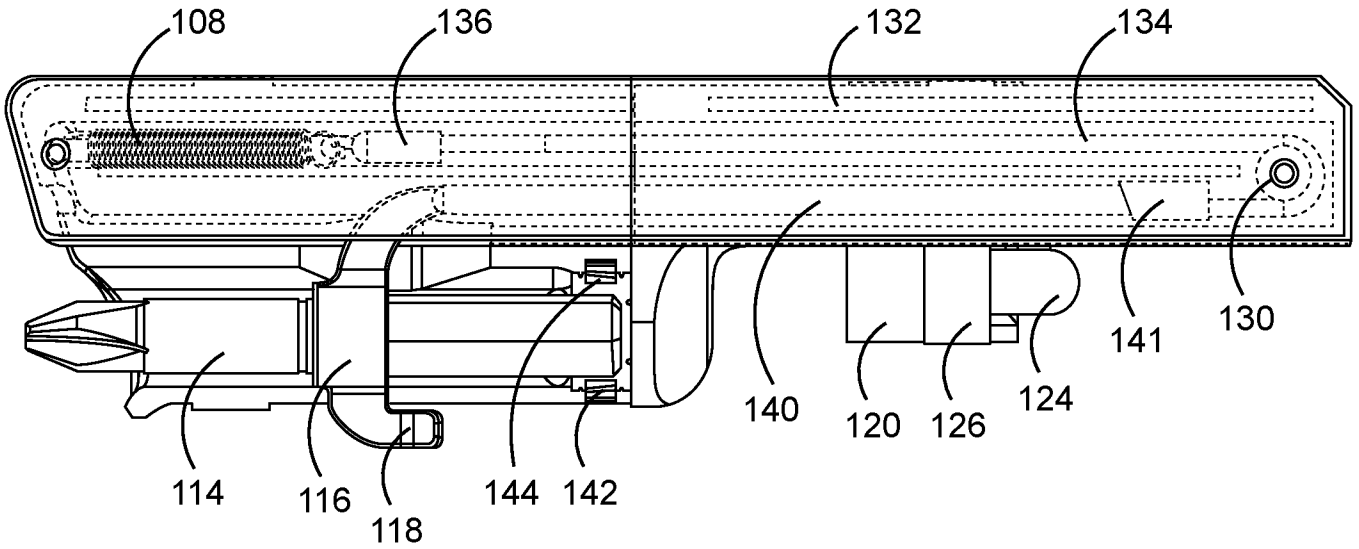
FIG. 6 is a top view of the individual lanyard system of FIG. 1, with transparent top covers.

FIG. 6 is a top view of the individual lanyard system of FIG. 1, with transparent top covers.

Figure 7:
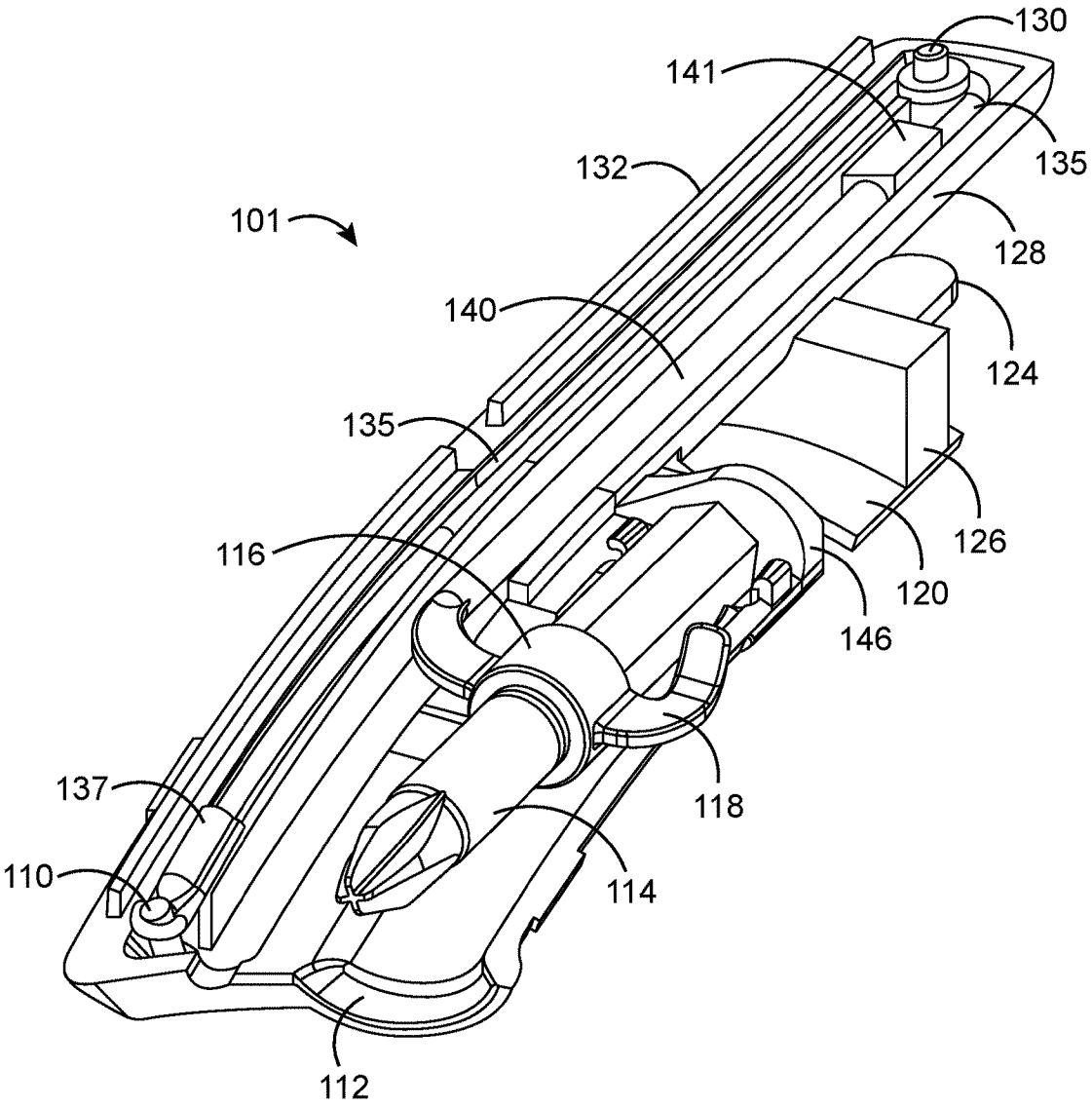
FIG. 7 is a perspective view of an individual lanyard system that can be mounted on a power tool, shown without top covers, utilizing an internal elastic cord, eliminating the need for a spring.

FIG. 7 is a perspective view of an alternate embodiment of an individual lanyard system 101, with the top covers removed, that can be mounted on a power tool. One significant change in this embodiment is in the retraction system, which in this embodiment utilizes an internal elastic cord 135, eliminating the need for the spring 108 shown in FIG. 1. Referring to FIG. 7, the independent lanyard system 101 is shown in a perspective view, with covers removed. It is termed independent in that multiple of these lanyard systems can be attached to a power tool, but do not rely on each other. Each independent lanyard system is self-sufficient. The lanyard system is made up of a lanyard assembly having a first end and a second end contained within a covered lanyard assembly housing 128 (top covers not shown). The assembly includes a lanyard strap 140 with two end regions with the first end region attached to a driver holder 116 holding a driver piece 114 outside of the lanyard assembly housing. The lanyard strap 140 lies inside the lanyard assembly housing 128, and lies in a first guiding tray within the lanyard assembly housing. At a first end of lanyard strap 140, lying outside of the lanyard assembly housing, it is attached to a driver piece holder 116 which holds a driver piece 114, which could be a variety of driver pieces to be discussed. Attached to the driver holder 116 is a friction wing 118 which can be used to pull the lanyard strap and driver piece 114 to attach the driver piece to the power tool housing (not yet shown). The friction wing 118 also acts to protect the driver holder 116 from the impact of the power tool in use. When not in use in the power tool (not shown) the driver piece 114 is pulled back to driver stop 146 and rests in a parking well 112 that is part of the independent lanyard system 101. At the lanyard strap second end the lanyard strap 140 is attached to an interior stop 141, which is then attached to a retraction system made up of an elastic cord 135 that is wrapped around a pully 130. The elastic cord 135 then runs into a second guiding tray and at the end of the cord is attached to an electric cord connector 137 that is mounted on a mount shaft 110. The elastic cord acts to pull the lanyard system back into the housing after being released from the power tool. A connecting system 120,124 designed into the power tool housing is configured to snap into receiver 126 when attaching lanyard system 101 to the power tool (not shown). An additional attachment between the lanyard system and the power tool is shown in FIG. 5.

Figure 8:
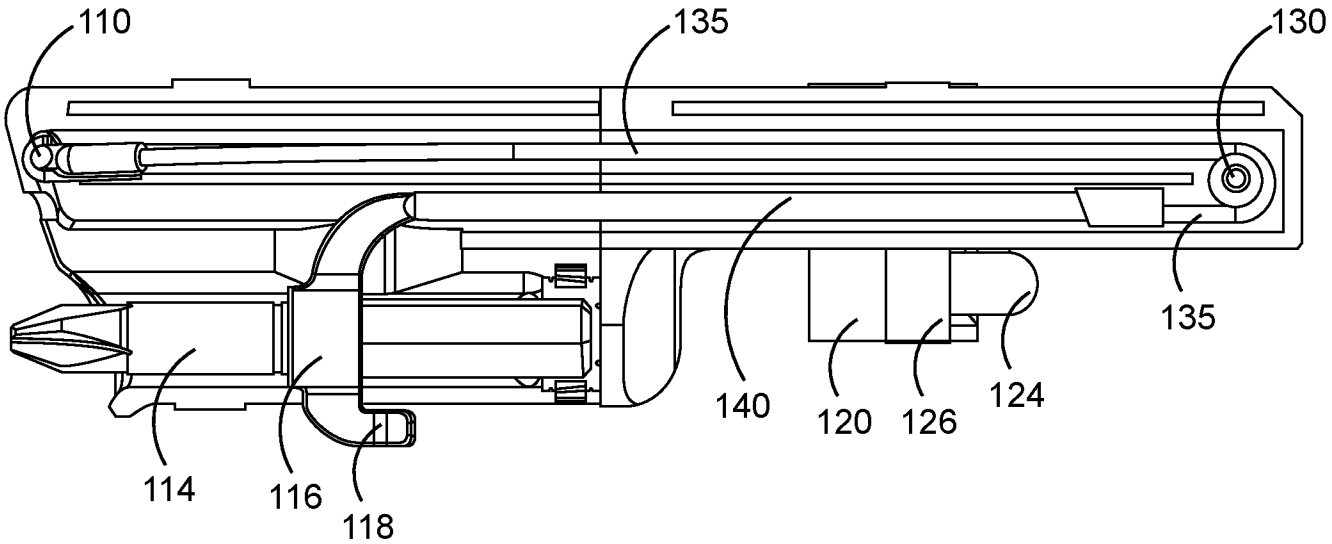
FIG. 8 is a top view of the individual lanyard system of FIG. 7

FIG. 8 is a top view of the alternate embodiment of the individual lanyard system of FIG. 7, without top covers.

Figure 9:
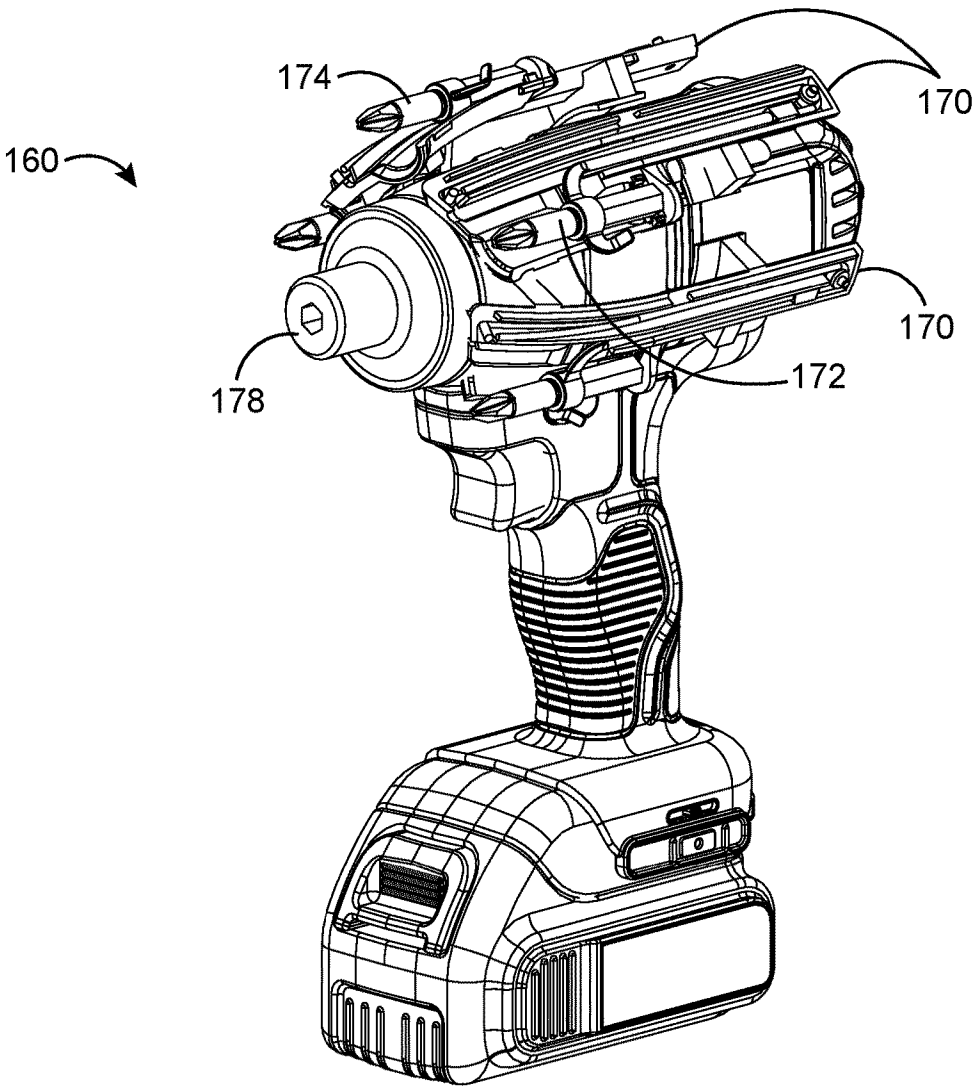
FIG. 9 is a perspective view of a typical power tool, fitted with multiple individual lanyard systems around the top housing of the power tool.

FIG. 9 is a perspective view of a typical power tool 160, fitted with multiple individual lanyard systems 170 around the top housing of the tool. For clarity, the individual lanyard systems 170 are shown with the top covers removed. The particular power tool shown could be of any type, such as an impact driver, drill, hammer drill, nut spinner, impact wrench, reciprocating saw, paint sprayer, sand blaster or water blaster. The individual lanyard systems could be of the embodiment shown in FIGS. 1-6, utilizing a flexible cord attached to a spring or of the alternate embodiment of FIGS. 7-8, utilizing an elastic cord. The manner of fitting the individual lanyard systems to a power tool is a design choice making use of slight modifications to the top housing of the power tool. Example manners of doing so are exhibited in FIG. 5 in which an engagement piece 150 is used to insert into a provided hole in the power tool housing when each of the independent lanyard systems 100 or 101 is mounted onto the power tool housing. Engagement piece 150 can be a dowel or dowels that are inserted into a provided hole or holes on the top of the power tool housing or possibly a blade for sliding into a provided blade receptacle in the top of the power tool housing. A second power tool connecting module to the power tool housing is provided by connecting system 120,122,124 (see FIG. 1) designed into the power tool housing. The connecting system is configured to snap into receiver 126 (part of the individual lanyard system 100 or 101). The combination of the two power tool connecting modules enables a secure connection of the individual lanyard systems to the power tool.

In use, once the independent lanyard systems are fitted to the top housing of the power tool, a user can select any one of the driver pieces such as driver piece 172 and simply pull out the lanyard, which extends driver 172 well past the driver piece receiver 178 to enable placing driver 172 into driver piece receiver 178. When a different type of driver is required the user simply removes driver 172 from driver piece receiver 178 and allows the retraction system of the spring (or the elastic cord) to retract the lanyard back into the lanyard housing, pulling driver piece 172 back to driver stop 146 to rest in the parking well 112 that is part of the independent lanyard system 100 or 101). User can then select an alternate driver, such as 174 and simply pull out the lanyard, which extends driver 174 well past the driver piece receiver 178 to enable placing driver 174 into driver piece receiver 178. When a driver piece is pulled back against driver stop 146 (of FIG. 1 or 7) it encounters the magnet before and below driver stop 146, which further secures the inactive driver during power tool operation.

Figure 10:
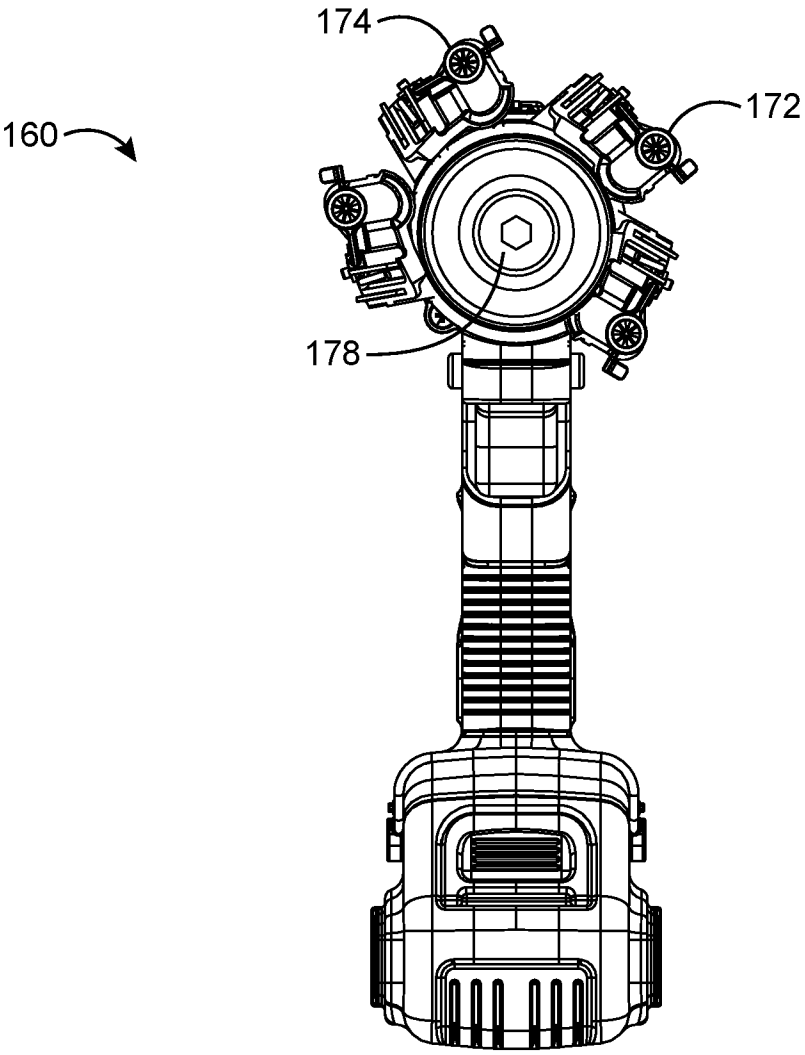
FIG. 10 is a front view of the fitted power tool of FIG. 9.

FIG. 10 is a front view of the fitted power tool of FIG. 9.

Figure 11:
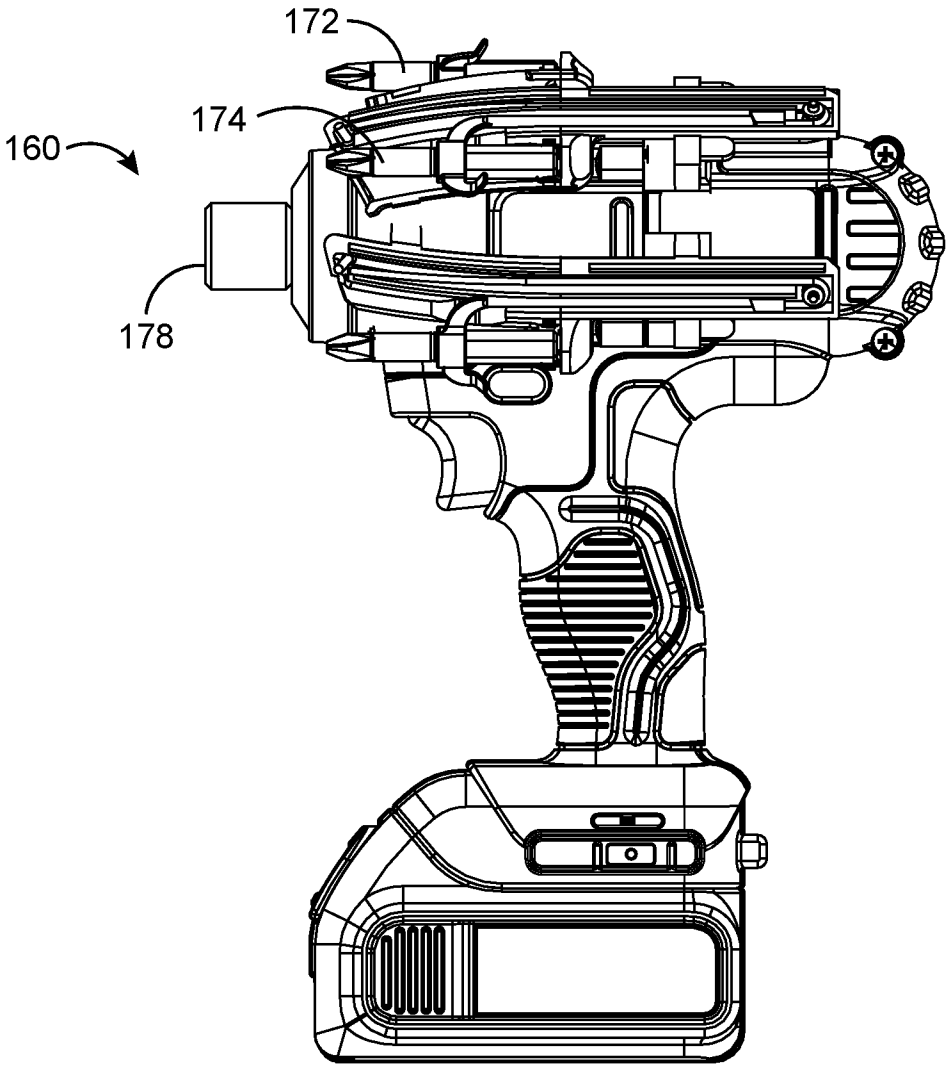
FIG. 11 is a side view of the fitted power tool of FIG. 9.

FIG. 11 is a side view of the fitted power tool of FIG. 9.

Figure 12:
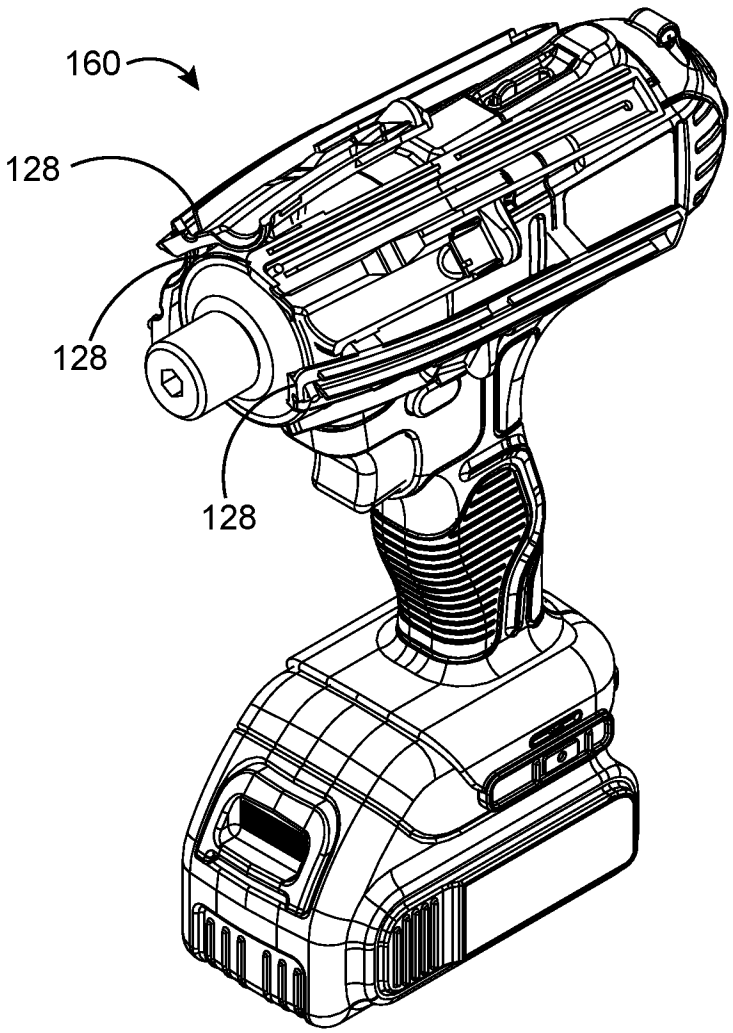
FIG. 12 is a perspective view of an alternate embodiment of the power tool of FIG. 9.

FIG. 12 is a perspective of view of an alternate embodiment of the power tool 160 of FIG. 9. In this embodiment power tool manufacturers could install multiple installations of the bottom housing 128 (FIGS. 1, 2, and 7) around the top housing of a power tool using any functional attachment method and then the end user could purchase and snap on the remainder any lanyard systems (all internal components plus the top cover) as needed. The functional attachment method could be any number of attachment means such as those described earlier in FIGS. 1, 5, and 7. Alternately the bottom housing 128 of FIGS. 1, 2, and 7 could be molded into the top housing of the power tool during manufacture of the tool.

It is contemplated that the power tool 160 can be powered manually, electrically, pneumatically, hydraulically or a combination thereof. By illustrative example, tool 160 could be an impact driver, drill, hammer drill, nut spinner, impact wrench, reciprocating saw, paint sprayer, sand blaster or water blaster. Driver pieces 172,174 could be a drill bit, screw bit, socket driver, chisel, saw blade, or nozzle. In short, the driver piece is an object removably fixed in a tool to perform a task such as, but not limited to tightening, loosening, drilling, chiseling, cutting or a combination there. In one embodiment, the driver piece is an object with radial symmetry that can be positioned in a piece receiver 178 and used in conjunction with tool 160 to accomplish a task, such as the ones described above. Driver pieces with a radial symmetry include but are not limited to Phillips bit, Robertson bit, hex bit, 12 point flange bit, hex socket bit, security hex socket bit, Torx bit, security Torx bit, tri-wing bit, torq-set bit, spanner head bit, clutch bit, one-way bit, double-square bit, triple square bit, polydrive bit, spline drive bit, double hex bit, Bristol bit, pentalobe bit, socket bit, drill bit, spiral cutting bit, cut off disc bit, drum sanding bit and/or a combination thereof. But in other embodiments, the driver piece could be a chisel, saw blade or other object used in conjunction with tool 160 to accomplish tasks such as removing or cutting material. In yet another embodiment, the driver piece is a nozzle used in conjunction with a tool 160 to accomplish tasks such as sand blasting or painting.

The lanyard strap 140 can be a cord, thong wire, cable or a combination thereof constructed of a durable material. Such durable material includes, but is not limited to plastic, metal, resilient materials or a combination thereof. It is contemplated that a cross section of lanyard strap 140 can be circular, arcuate, polygonal or a combination thereof. In one embodiment, lanyard strap 140 has a rectangular cross section and is constructed from a stiff plastic with minimal flex and stretch. In another embodiment, lanyard strap 140 has a circular cross section and is constructed of metal with sufficient flexibility to make a loop without kinking the metal.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

The invention claimed is:

1. A lanyard system for a driver piece connected to a power tool housing comprising:

a) a lanyard assembly having a first end and a second end contained with a lanyard assembly housing;

b) said lanyard assembly further comprising a lanyard strap with two end regions, said first end region attached to a driver piece holder holding a driver piece outside of the lanyard assembly housing and said second end region attached to an internal stop within the lanyard assembly housing;

c) said lanyard strap of said lanyard assembly deployed into a first guiding tray within lanyard assembly housing enclosing the lanyard assembly;

d) said internal stop within said lanyard assembly housing further attached to a first end of a retraction system which encircles 180 degrees around a pully at the second end of the lanyard assembly and returns within a second guiding tray of the lanyard assembly housing enclosing the lanyard assembly;

e) said second end of the retraction system attached to the first end of the lanyard assembly contained within the lanyard assembly housing.

2. The lanyard system for a driver piece connected to a power tool housing of claim 1 wherein the retraction system is a flexible cord encircling the pully and attached to a spring connector which is then attached to a spring that is attached to the first end of the lanyard assembly.

3. The lanyard system for a driver piece connected to a power tool housing of claim 1 wherein the retraction system is a flexible cord encircling the pully and attached to the first end of the lanyard assembly.

4. The lanyard system for a driver piece connected to a power tool housing of claim 1 wherein a friction wing is attached to the driver holder holding the driver piece outside of the lanyard assembly.

5. The lanyard system for a driver piece connected to a power tool housing of claim 1 wherein said attachment of the second end of the retraction system to the first end of the lanyard assembly is made onto a mount shaft.

6. A power tool contained within a top housing of the power tool, with multiple attached lanyard systems, with each lanyard system contained within a lanyard system housing comprising a) a lanyard assembly having a first end and a second end contained within a lanyard assembly housing with a top cover enclosing internal components;

b) said lanyard assembly further comprising a lanyard strap with two end regions, said first end region attached to a driver piece holder holding a driver piece outside of the lanyard assembly housing and said second end region attached to an internal stop within the lanyard assembly housing;

c) said lanyard strap of said lanyard assembly deployed into a first guiding tray within lanyard assembly housing enclosing the lanyard assembly;

d) said internal stop within said lanyard assembly housing further attached to a first end of a retraction system which encircles 180 degrees around a pully at the second end of the lanyard assembly and returns within a second guiding tray of the lanyard assembly housing enclosing the lanyard assembly;

e) said second end of the retraction system attached to the first end of the lanyard assembly contained within the lanyard assembly housing; and wherein f) each lanyard system comprising a lanyard attached to a driver piece holder that holds a driver piece and is connected to a retraction system and providing a different driver piece that can be selected by pulling it out of its attached lanyard system, extending the driver piece past a driver piece receiver and inserting the driver piece into the driver piece receiver.

7. The power tool with multiple attached lanyard systems of claim 6, wherein each of the driver pieces after use can be removed by removing the driver piece from the driver piece receiver of the power tool and allowing its retraction system to retract the lanyard into the lanyard system housing, returning the driver piece to a storage position.

8. The power tool with multiple attached lanyard systems of claim 6 wherein the power tool is initially supplied with multiple pre-installed bottom housings of the attached lanyard systems already attached to the power tool housing.

9. The power tool with multiple attached lanyard systems of claim 7, wherein the internal components and top cover of each lanyard system can be snapped onto each of the pre-installed bottom housings by the end user.

10. The power tool with multiple attached lanyard systems of claim 8 wherein the attachment of the pre-installed bottom housings is done by molding each of the pre-installed bottom housings into the top housing of the power tool during manufacture of the power tool.

* * * * *